US006453972B1

(12) United States Patent
Sher et al.

(10) Patent No.: US 6,453,972 B1
(45) Date of Patent: Sep. 24, 2002

(54) ROLL-UP SHUTTER

(75) Inventors: Ephraim Sher, Carmiel (IL); Eitan Reani, Yehud (IL)

(73) Assignee: Tristeck Ltd., Carmiel (IL)

( * ) Notice: Subject to any disclaimer, the term of this patent is extended or adjusted under 35 U.S.C. 154(b) by 0 days.

(21) Appl. No.: 09/622,485

(22) PCT Filed: Feb. 17, 1999

(86) PCT No.: PCT/IL99/00102

§ 371 (c)(1),
(2), (4) Date: Feb. 28, 2001

(87) PCT Pub. No.: WO99/41480

PCT Pub. Date: Aug. 19, 1999

(30) Foreign Application Priority Data

Feb. 17, 1998 (IL) ..... 123347

(51) Int. Cl.[7] ..... E06B 9/08
(52) U.S. Cl. ..... 160/133; 49/74.1
(58) Field of Search ..... 160/133, 201; 49/87.1, 64, 74.1

(56) References Cited

U.S. PATENT DOCUMENTS

| | | | | |
|---|---|---|---|---|
| 2,955,815 | A | | 10/1960 | Muhr |
| 3,188,074 | A | | 6/1965 | Revitz et al. |
| 3,302,692 | A | | 2/1967 | Grau |
| 3,429,355 | A | | 2/1969 | Griesser |
| 3,989,084 | A | | 11/1976 | Inamura et al. |
| 4,449,563 | A | * | 5/1984 | Toda et al. |
| 4,505,070 | A | | 3/1985 | Clipp et al. |
| 4,618,132 | A | | 10/1986 | Kimura et al. |
| 4,715,421 | A | * | 12/1987 | Erber |
| 4,846,244 | A | | 7/1989 | Rosenfeld |
| 5,188,161 | A | * | 2/1993 | Erber |
| 5,566,737 | A | | 10/1996 | Erber |
| 5,566,738 | A | * | 10/1996 | Yadidya |
| 5,887,636 | A | * | 3/1999 | Neukam |

FOREIGN PATENT DOCUMENTS

| | | |
|---|---|---|
| CH | 427 208 | 12/1966 |
| FR | 1 129 755 | 1/1957 |
| IL | 84774 | 5/1988 |

* cited by examiner

*Primary Examiner*—Blair M. Johnson
(74) *Attorney, Agent, or Firm*—Eitan, Pearl, Latzer & Cohen-Zedek

(57) ABSTRACT

A roll-up shutter including a rotary drum (3) mounted horizontally at the upper end of a frame (2) above a window; a slat assembly (4) including a plurality of interconnected pivotal slats (40) rollable on the drum (3) to a rolled-up condition above the window; and a tilting assembly (5) for selectively tilting the slats (40) to open or closed positions when the slat assembly (4) at least partially covers the window.

23 Claims, 15 Drawing Sheets

ROLL-UP SHUTTER

FIELD OF THE INVENTION

The present invention relates to shutters for windows or doors, and particularly to the roll-up type shutter.

BACKGROUND OF THE INVENTION

A typical roll-up type shutter includes a slat assembly of a plurality of slats rollable on a rotary drum or shaft mounted horizontally at the upper end of the shutter. The slat assembly is thus rollable on the drum to a rolled-up non-operative condition above the window, or to a rolled-down operative condition fully or partially covering the window. Such shutters generally do not include a tilting assembly for tilting the slats to control the light as desired when the shutter is in the rolled-down condition.

Roll-up shutters of special construction are know which do permit the slats to be tilted when the slat assembly is in its down, operative position. However, such shutters are extremely expensive, costing many times the cost of the simple roll-up type shutter which does not permit tilting the slats. For example, a typical cost of the non-tilting type roll-up shutter is in the order of $100 per meter; whereas the cost of the tilting-type shutter is in the order of $2000–$4000 per meter. Moreover, the tilting-type shutters now commercially available do not permit the slats to be tilted to a fully-open or partially-open position when the slat assembly is only partially rolled-down such that only the lower part of the slat assembly is in operative position with respect to the window.

SUMMARY OF THE INVENTION

An object of the present invention is to provide a roll-up shutter having advantages in the above respects.

According to a broad aspect of the present of the present invention, there is provided a roll-up shutter, comprising: a frame defining a window; a rotary drum mounted horizontally at the upper end of the frame above the window; a slat assembly including a plurality of interconnected pivotal slats; the slat assembly being rollable on the drum from a rolled-up condition above the window to a rolled-down condition covering the window; and a tilting assembly for selectively tilting the slats to an open, partially-closed and fully-closed position when the slat assembly covers at least a part of the window opening.

According to further features in the preferred embodiments of the invention described below, the tilting assembly includes a common actuator extending the length of the window and terminating below the drum, the common actuator being coupled only to the slats aligned with the window in the fully rolled-down condition or partially rolled-down condition of the slat assembly for selectively tilting the coupled slats to an open, partially closed, or filly closed position.

According to one described preferred embodiment, the tilting assembly includes: a channel member extending vertically at one side of the frame, the channel member being open at its upper end and along one side for receiving a pin at the end of each of the slats; and an actuator mechanism for moving the channel member and the slat pins received therein to pivot the slats to their open, partially-closed, and fully-closed positions; the upper end of the channel member being located below the rotatable drum such that when rolling-up the slat assembly onto the drum, the slat end pins leave the channel member thereby permitting the slats to pivot to their fully-closed positions.

According to a second described preferred embodiment, the tilting mechanism further includes a locking mechanism selectively movable to a locking position for locking the tilting mechanism against tilting the slats, or to a releasing position for releasing the tilting mechanism for tilting the slats.

According to further features in the second described embodiment, the common actuator includes a vertical bar extending vertically at one side of the frame and coupled to the slats aligned with the window; and the tilting assembly further includes a coupling mechanism for each slat coupling the slat to the vertical bar, and an actuator mechanism for moving the bar vertically in one direction to pivot the coupled slats towards their open positions, and in the opposite direction to pivot the coupled slats towards their fully-closed positions.

According to another aspect of the present invention, there is a provided a roll-up shutter, comprising a frame defining a window; a rotary drum mounted horizontally at the upper end of the frame above said window, and a slat assembly including a plurality of interconnected pivotal slats, said slat assembly being rollable on the drum from a rolled-up condition above said window to a rolled-down condition covering said window; each of said plurality of slats being pivotally mounted eccentrically with respect to the longitudinal axis of the slat In the described preferred embodiment, the pivotal end of each slat is partially covered by the non-pivotal end of the next adjacent slat in the rolled-up condition of the slat assembly.

As will be described more particularly below, a roll-up shutter constructed in accordance with the foregoing features may not only be rolled-up to its non-operative position and rolled-down to its operative position, but when the shutter is in its rolled-down operative position the slats may be tilted as desired, in order to control the light passing through the shutter. In addition, such a shutter does not require that the slats be in their closed positions if the slat assembly is to be wound on the drum since the slats are automatically moved to their closed positions when the slat assembly is being wound onto the drum. Moreover, such a shutter permits the slat assembly to be partially rolled up and still have the slats aligned with the window to be fully open or partially open to control the light passing through the window. Finally, such a shutter can be constructed with relatively simple parts which can be produced and assembled in volume and at low cost, comparable to the non-tilting type roll-up shutter in present use.

Further features and advantages of the invention will be apparent from the description below.

BRIEF DESCRIPTION OF THE PRESENT INVENTION

The invention is herein described, by way of example only, with reference to the accompanying drawings, wherein.

Figure 1:
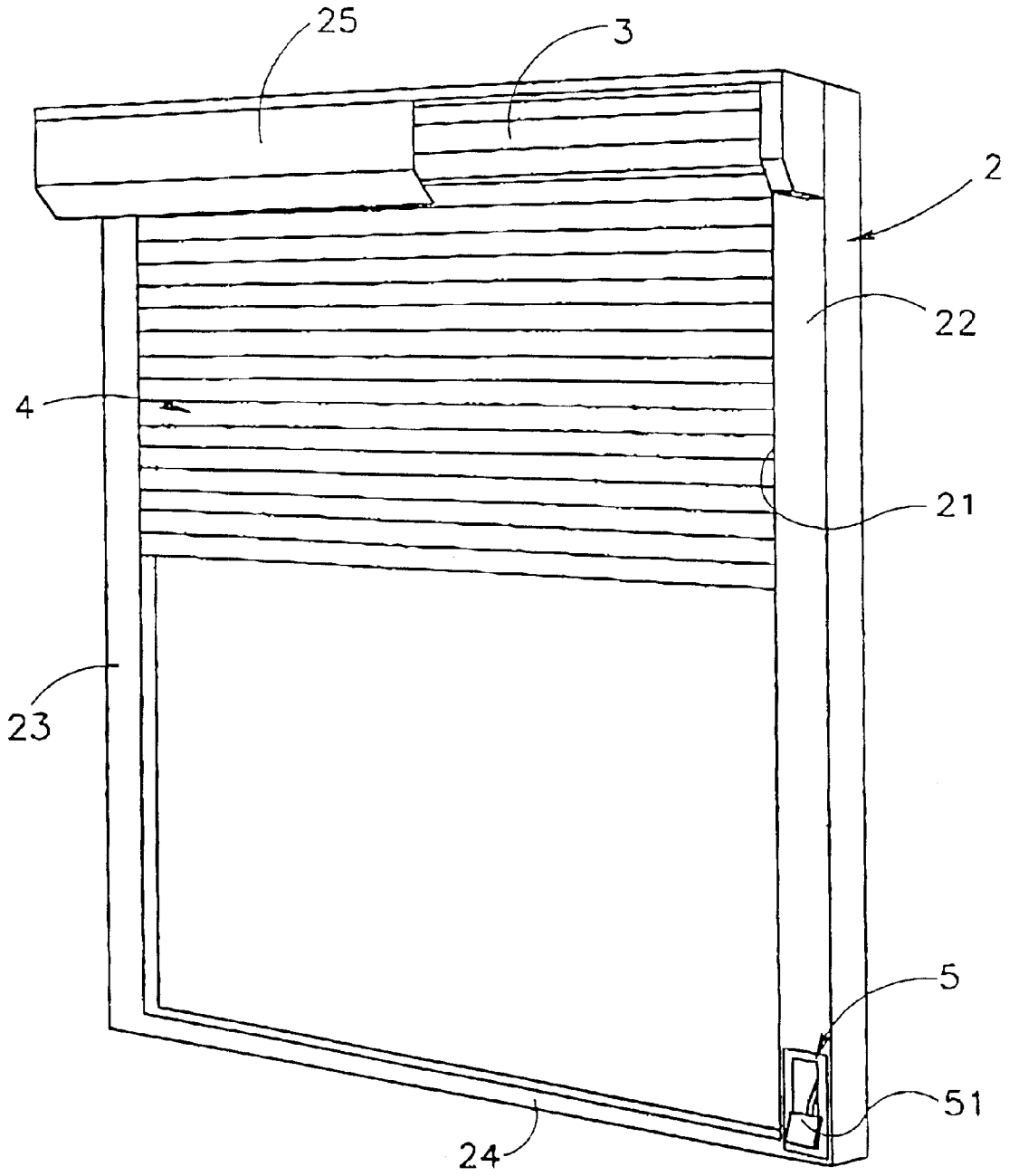
FIG. 1 illustrates one form of roll-up shutter constructed in accordance with the present invention.
Figure 2:
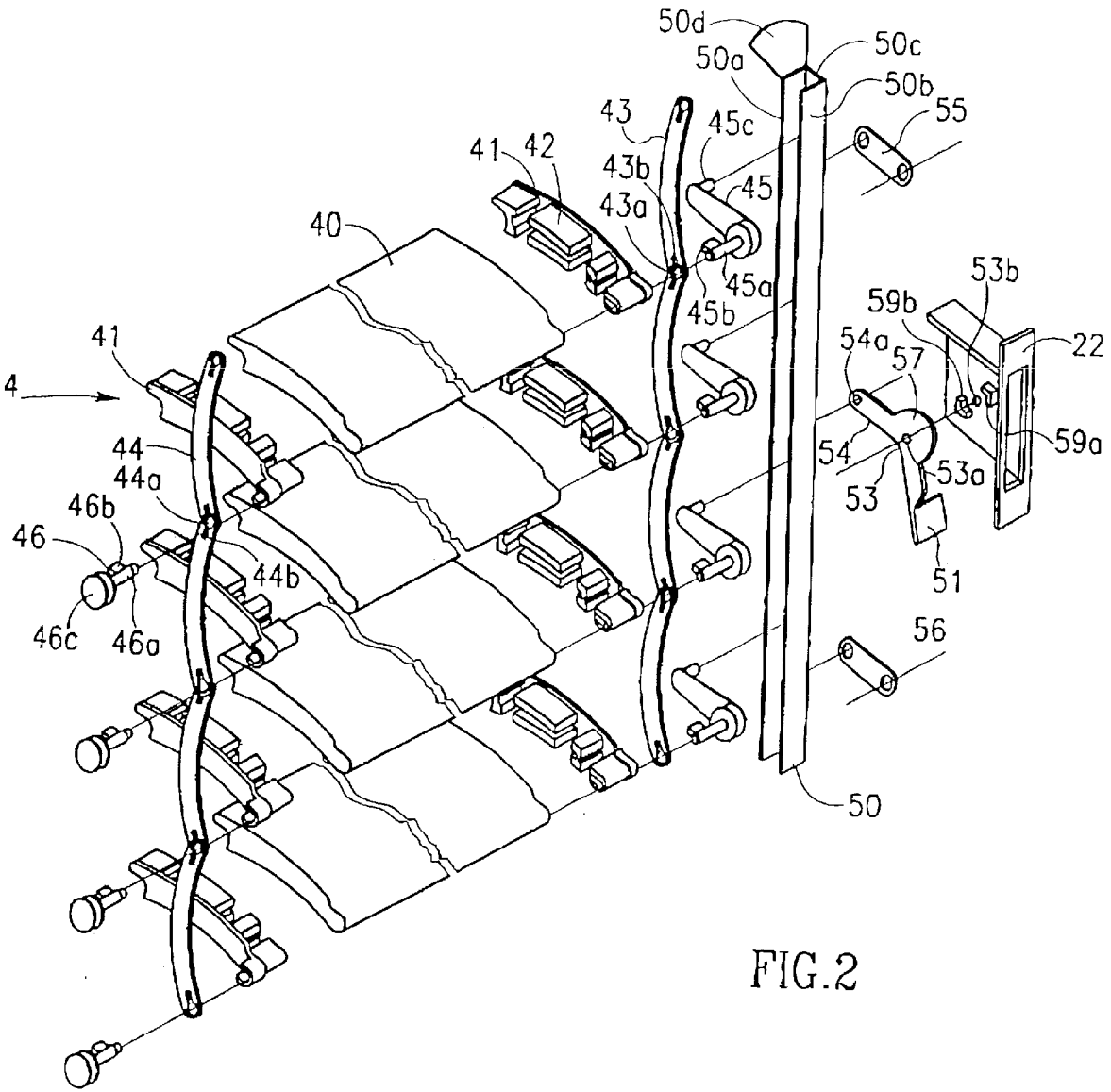
FIG. 2 is an exploded perspective view illustrating many of the components of the shutter of FIG. 1.
Figure 3:
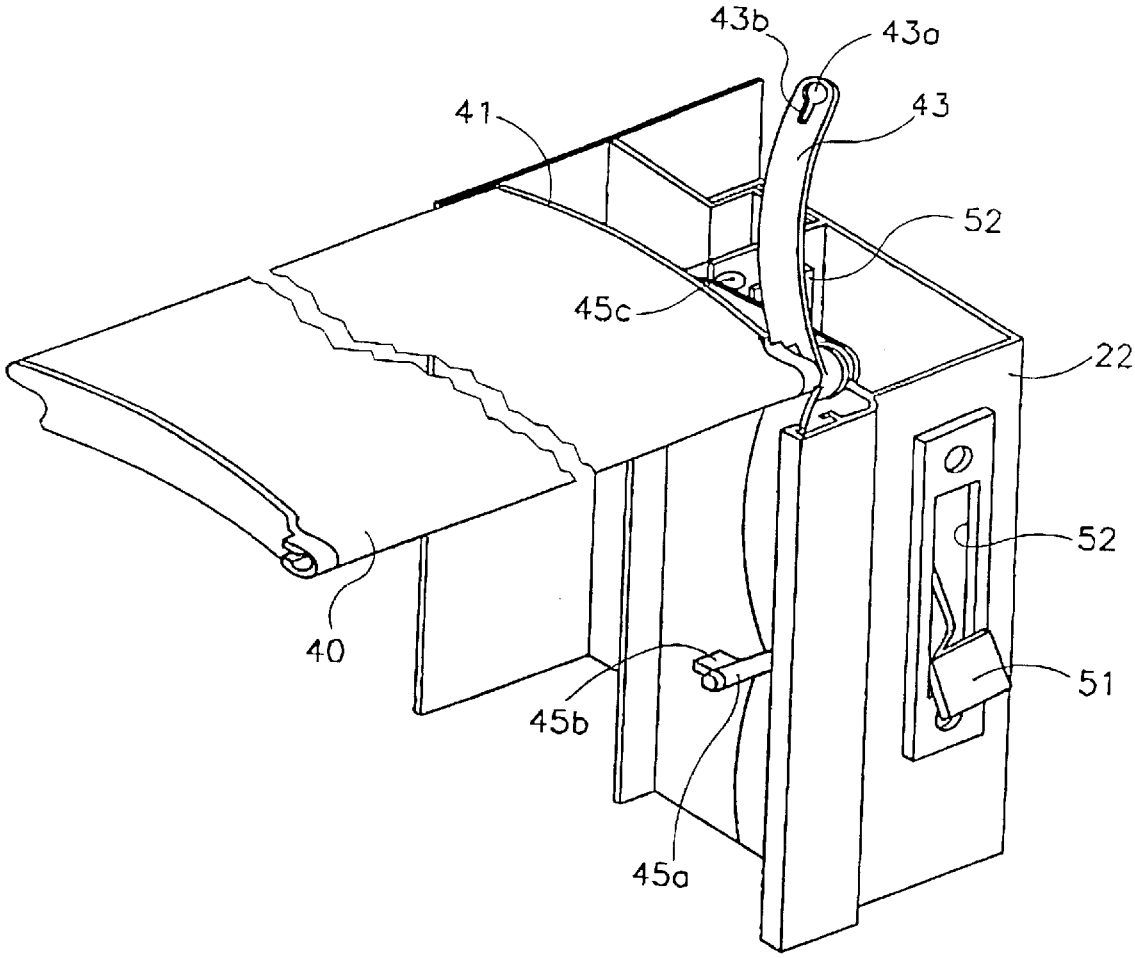
FIG. 3 is an assembly view particularly illustrating the tilting mechanism in the shutter of FIGS. 1 and 2.
Figure 5:
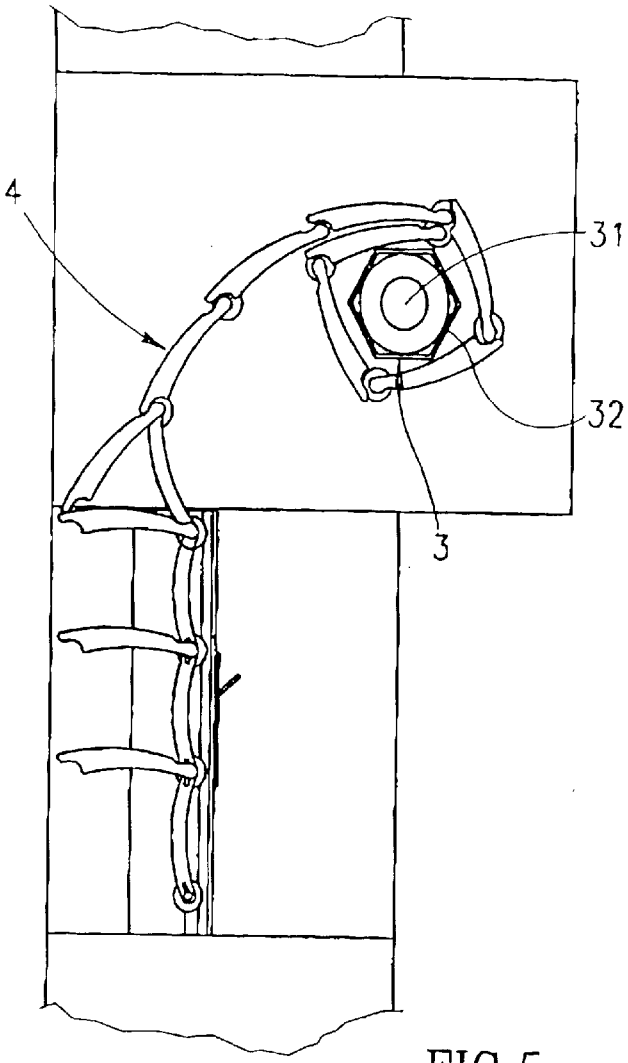
Figure 4:
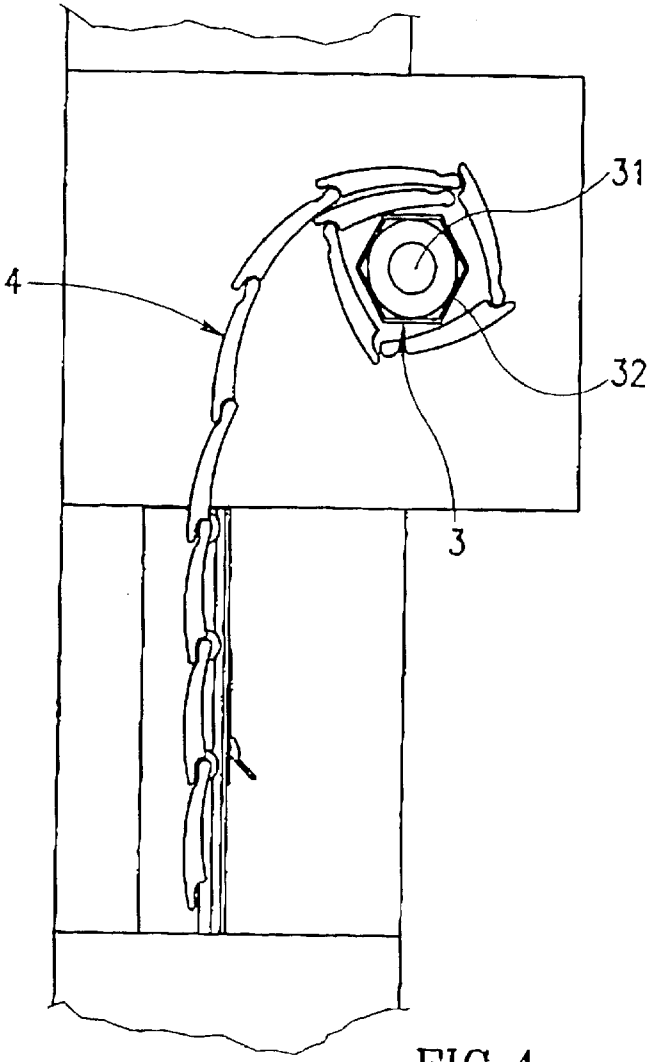
Figure 6A:
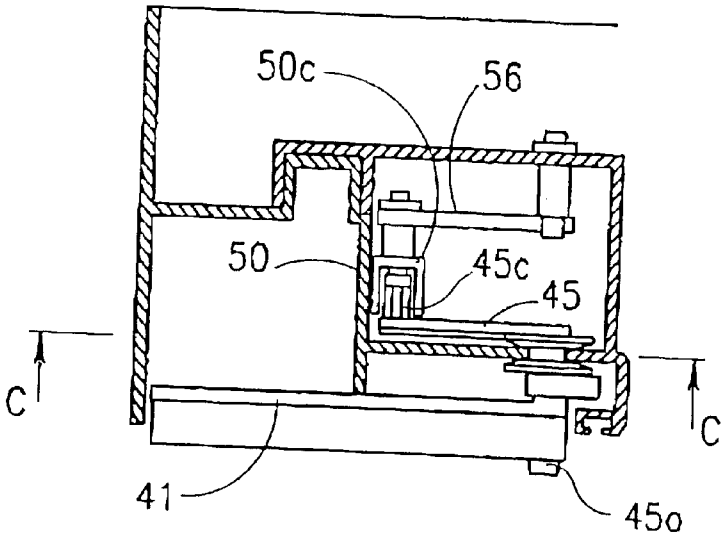
Figure 6:
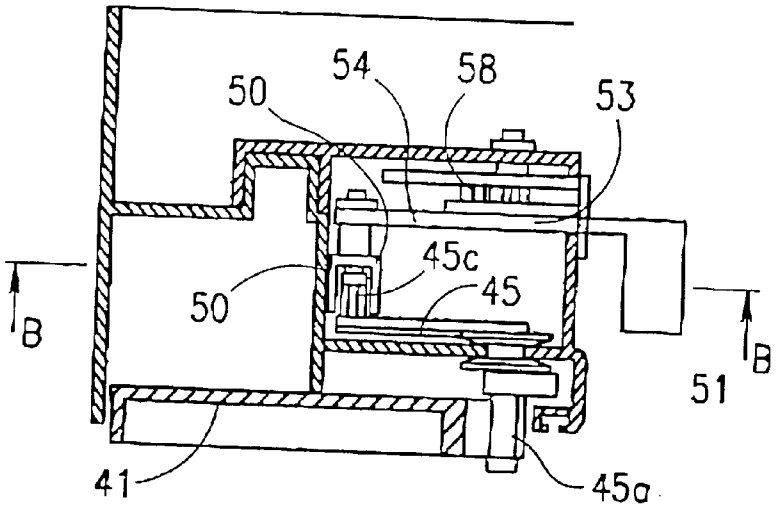
Figure 6B:
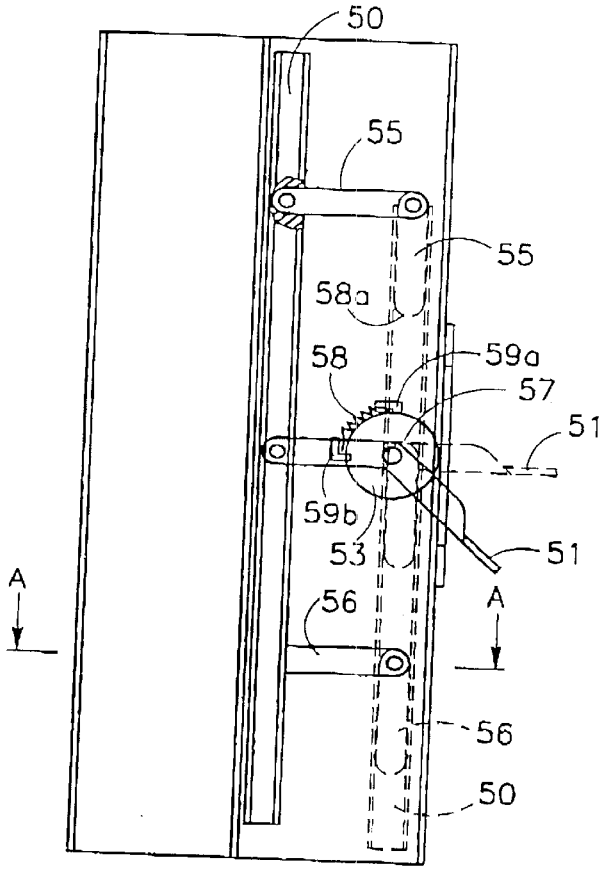

FIG. 4 diagramatically illustrates the shutter of FIGS. 1–3 in a partially operative position of the slat assembly with the slats in their closed (vertical) positions;

FIG. 5 is a view similar to that of FIG. 4 but showing the operative slats in their open (horizontal) positions;

FIG. 6 is a top plan view of the tilting mechanism of FIG. 3;

FIG. 6*a* is a sectional view along line A—A of FIG. 6*b;*

Figure 6C:
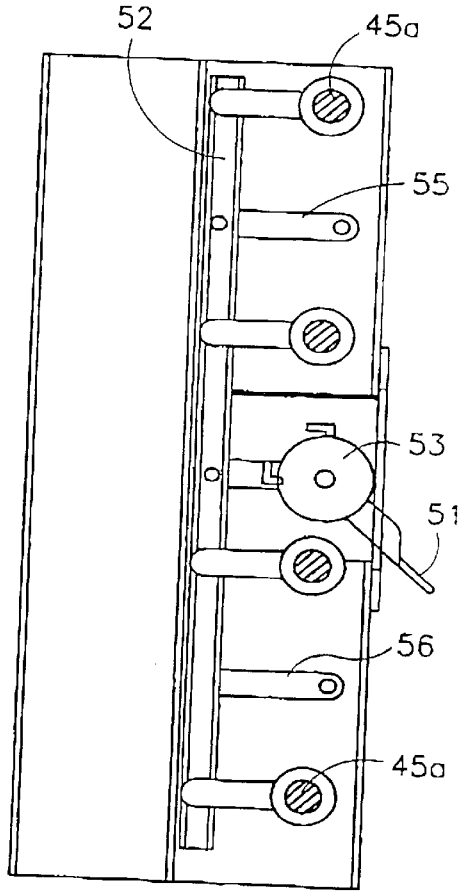

FIG. 6*b* is a sectional view along line B—B of FIG. 6;

FIG. 6*c* is a sectional view along line C—C of FIG. 6*a*.

Figure 7:
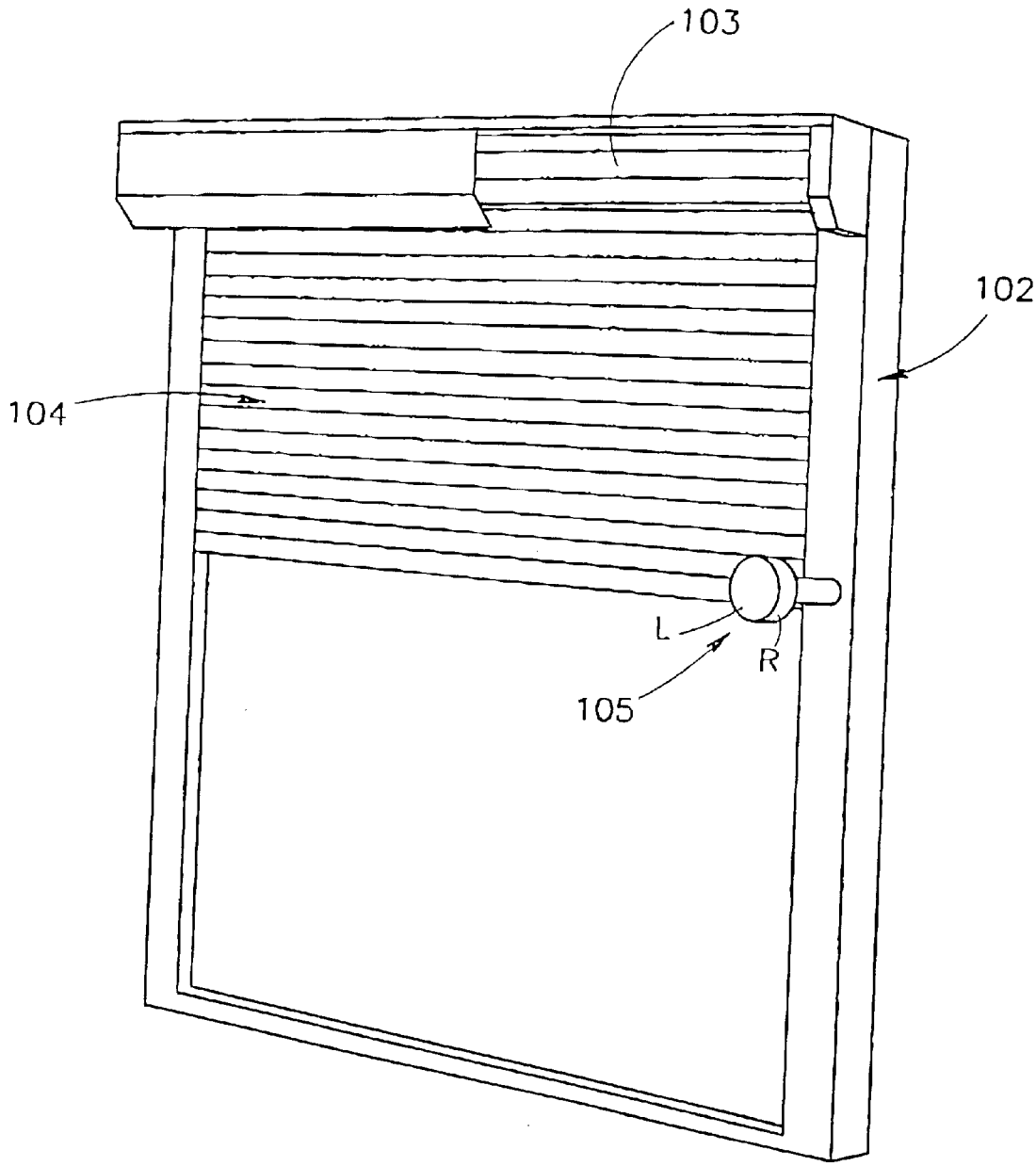
Figure 8:
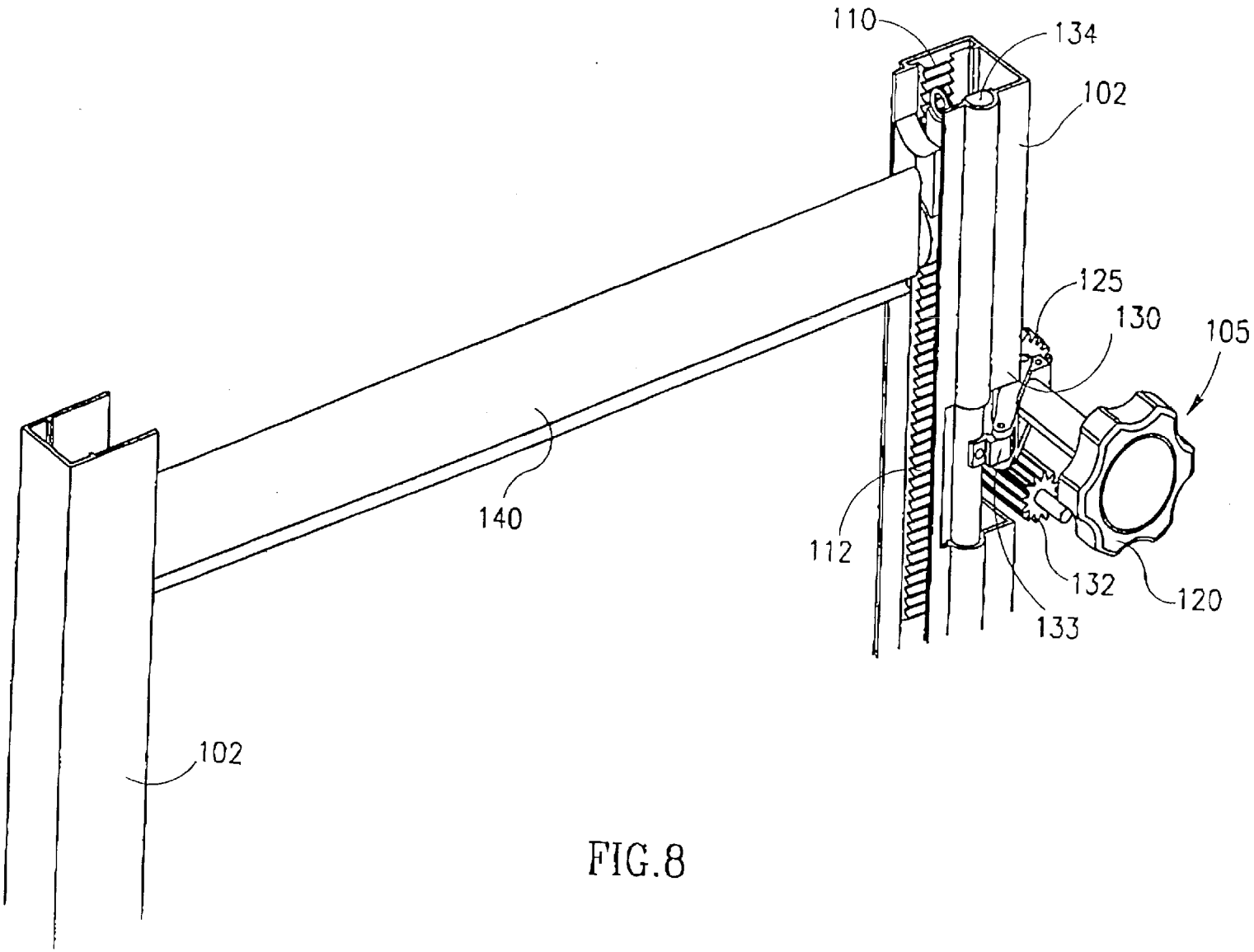
Figure 9:
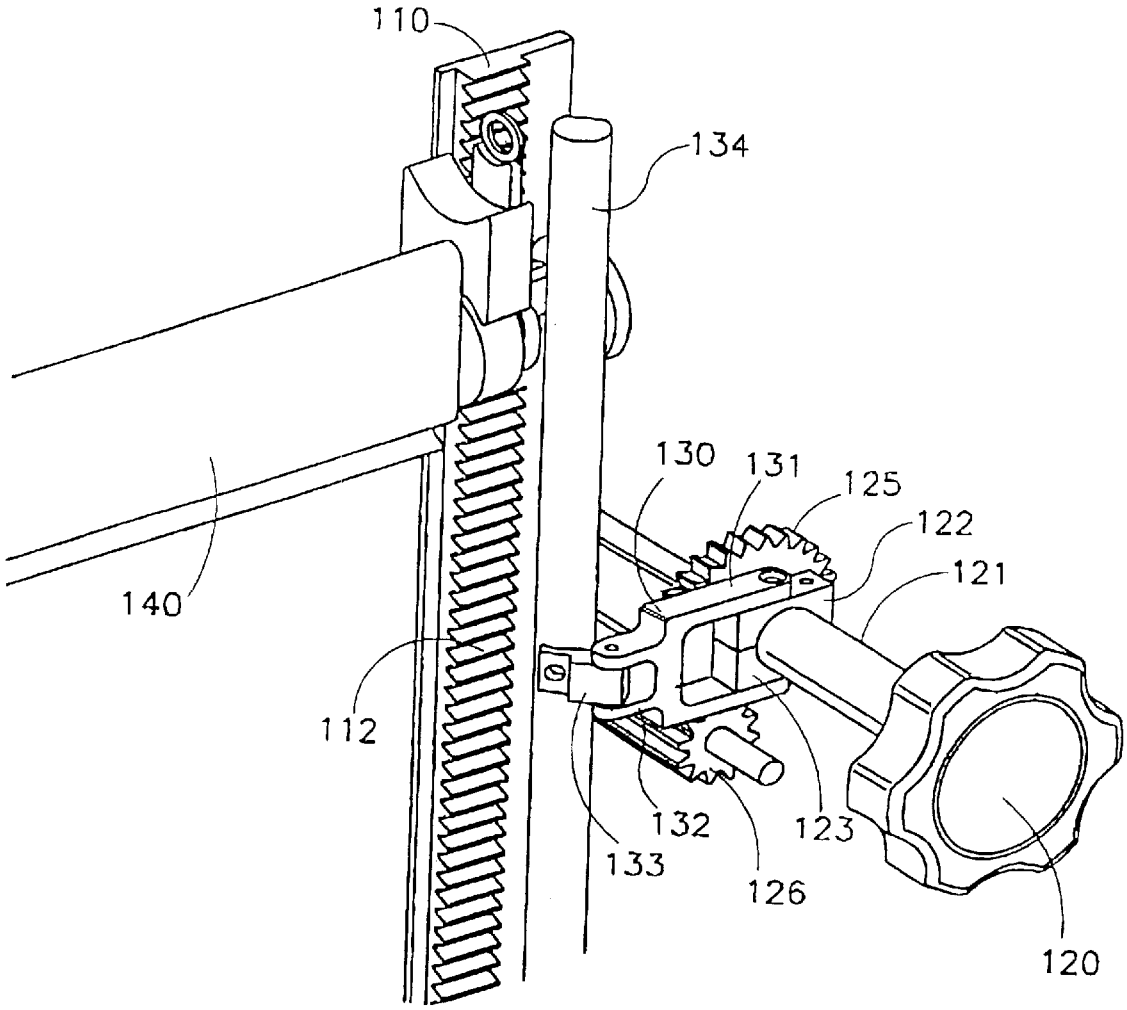
Figure 10:
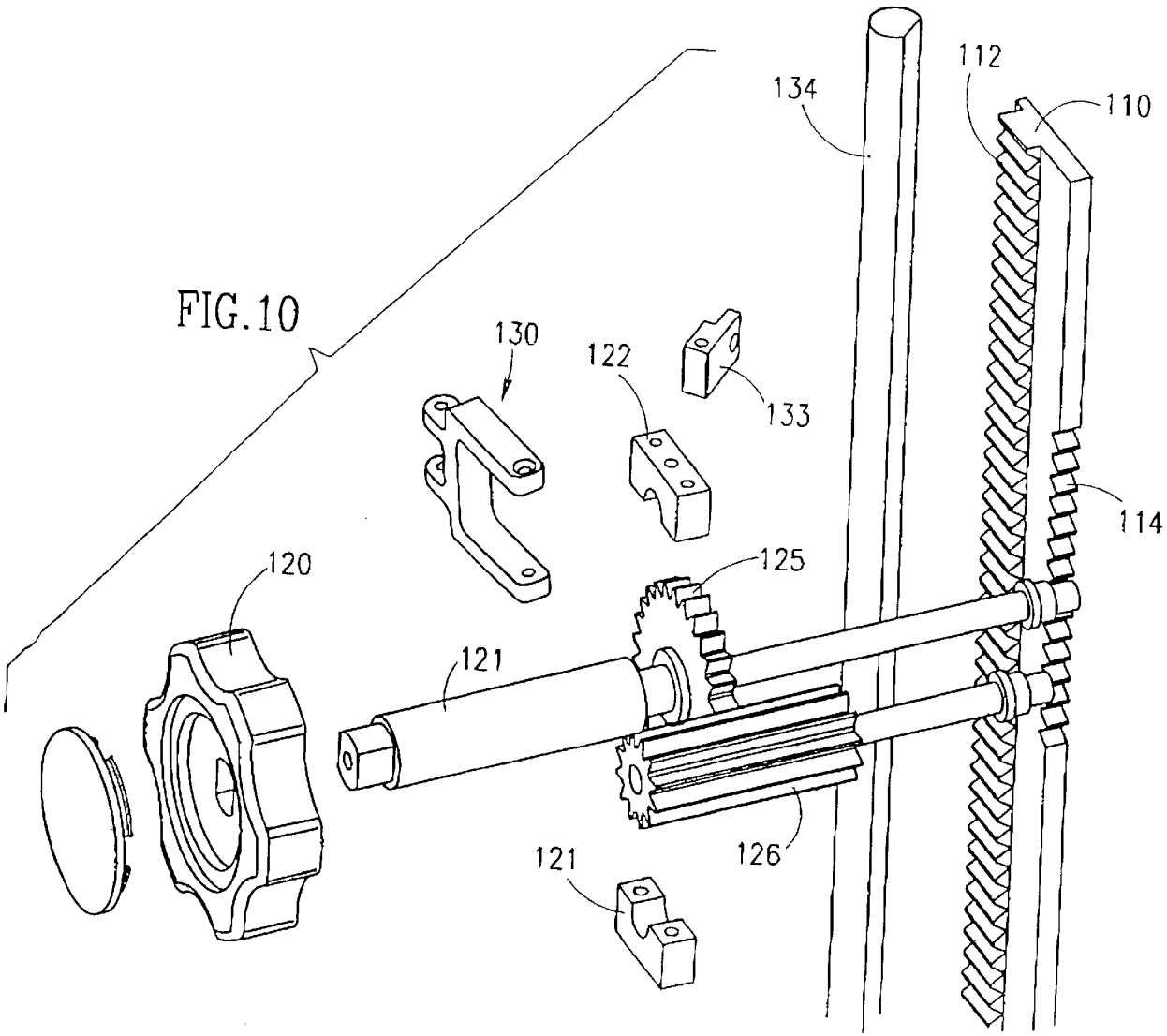
Figure 11:
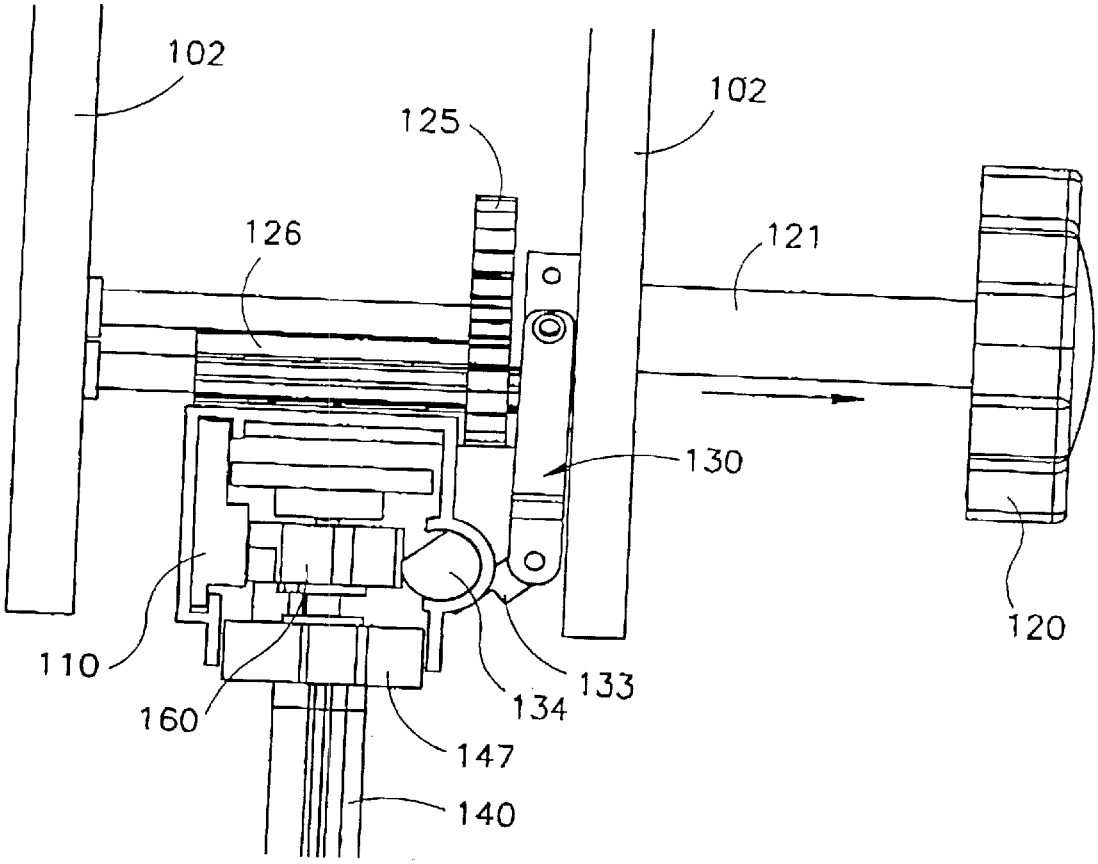
Figure 12:
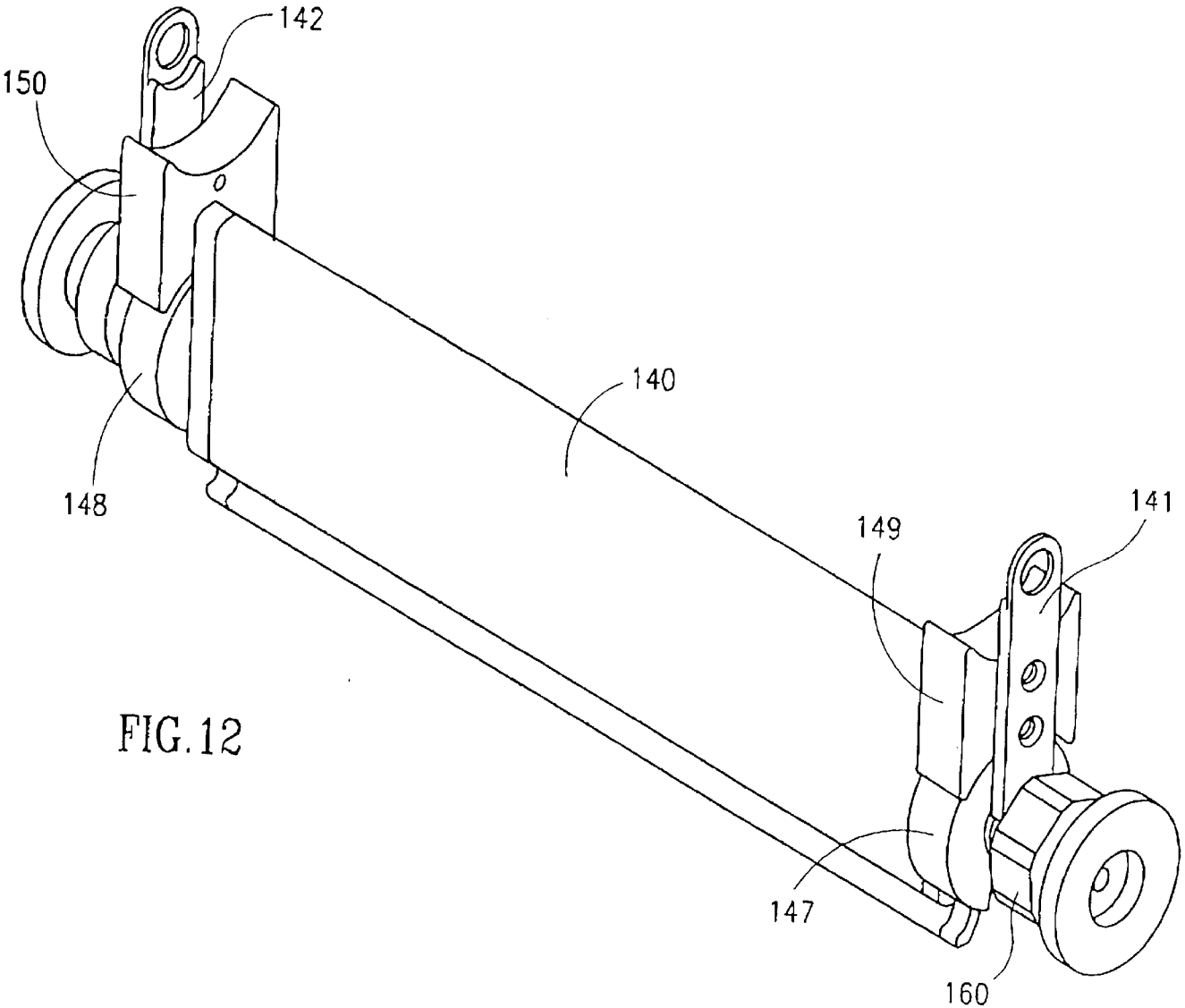
Figure 13:
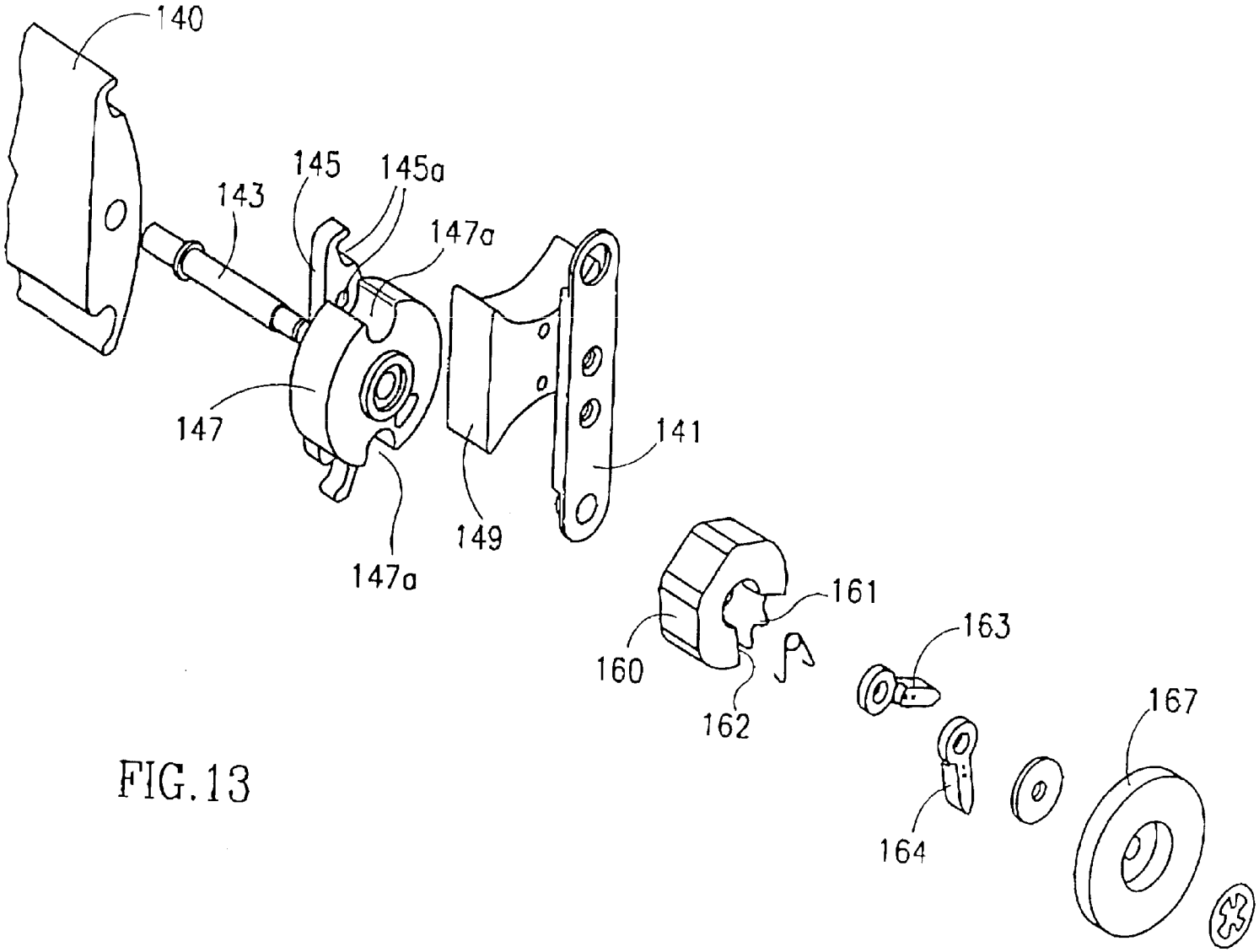
Figure 14:
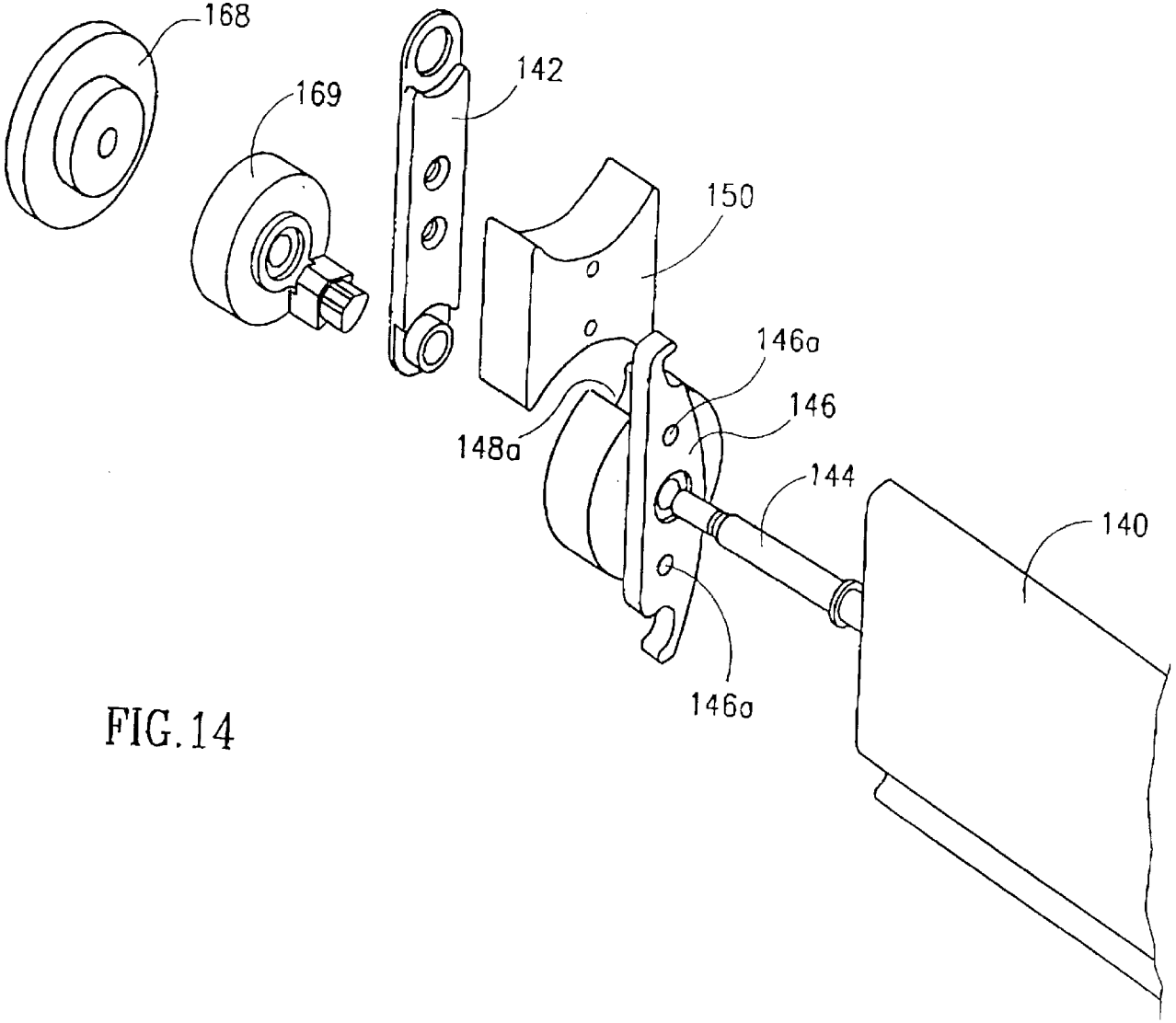
Figure 16:
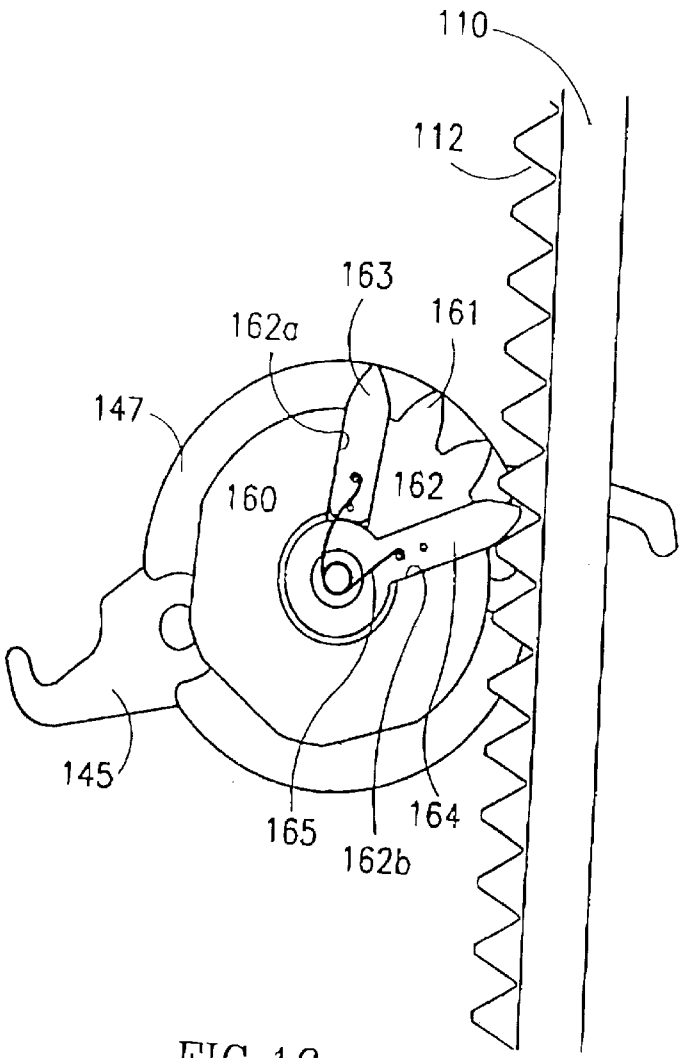
Figure 15:
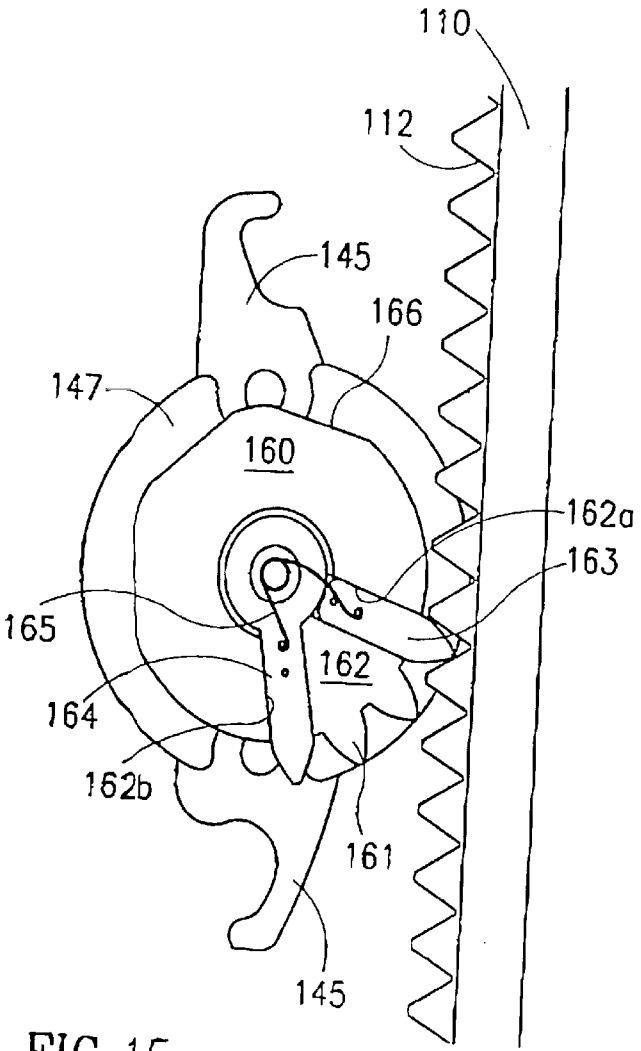

FIG. 7 illustrates another form of roll-up shutter constructed in accordance with the present invention;

FIG. 8 illustrates a part of the tilting assembly in the released condition permitting tilting of the individual slats;

FIG. 9 illustrates a part of the tilting assembly in the locking condition preventing tilting of the slats, and also an electrical circuit controlled by the tilting assembly to prevent roll-up or roll-down of the slats when in its locked condition;

FIG. 10 is an exploded view more particularly illustrating the tilting assembly of FIGS. 8 and 9;

FIG. 11 is a top plan view illustrating the tilting assembly of FIGS. 8 and 9 in the locked condition of the assembly;

FIG. 12 is a perspective view illustrating the pivotal mounting of each slat and a portion of the tilting assembly for tilting the slat;

FIG. 13 is an exploded perspective view illustrating the portion of the pivotal mounting of the slat acted upon by the tilting assembly;

FIG. 14 is a perspective view illustrating the pivotal mounting of the opposite end of each slat;

FIG. 15 is a side elevational view illustrating a slat in its closed position before the shutter assembly is raised or lowered; and FIG. 16 illustrates a slat in its open condition before the shutter assembly is raised or lowered.

DETAILED DESCRIPTION OF PREFERRED EMBODIMENTS

The shutters illustrated in the drawings are of the roll-up type to be placed over a window (or door) opening, in which the slat assembly is normally in an operative position covering the window opening, but may be fully or partially rolled-up to a non-operative position on a drum or shaft at the upper end of the shutter. As will be described more particularly below, a main advantage of the shutters illustrated in the drawings is that they permit the slats to be tilted as desired to control the light, not only when the slats are in their fully-down position, but also when they are in their partially-down position.

The Shutter of FIGS. 1–6

With reference first to FIG. 1, the illustrated shutter includes a frame, generally designated 2, having a drum or shaft 3 mounted horizontally at the upper end of the frame, and a slat assembly, generally designated 4, rollable on drum 3 to a fully or partially operative position fully or partially covering the window (or door) opening framed by the shutter, or to a non-operative position wound on the drum 3. The illustrated shutter further includes a tilting assembly, generally designated 5, for tilting the slat of the slats assembly 4 to their open, partially-closed, or fully-closed positions, when the slat assembly 4 is in its fully or partially operative position with respect to the window opening.

Frame 2 is applied in any suitable manner to overlie the window (or door) opening of the building structure with which the shutter is to be used, and includes a rectangular window opening 21 to be aligned with the building structure window (or door) opening. Window opening 21 of the shutter is defined by two vertical sections 22, 23 at the opposite sides of the shutter frame, a bottom section 24 at the bottom of the frame, and an upper section 25 at the upper end of the frame and serving to house rotary drum 3.

As shown particularly in FIGS. 4 and 5, the rotary drum 3 is mounted on a horizontal shaft 31. Preferably, the outer surface of drum 3 is of hexagonal configuration, as shown at 32, but may be of cylindrical or other suitable configuration to receive the slat assembly 4 when rolled onto the drum.

The construction of slat assembly 4 is best seen in FIG. 2. It includes a plurality of hollow plastic slats 40 each closed at its opposite ends by a pair of end elements 41 integrally formed with bosses 42 for receiving the opposite ends of the slats. The slats 40 are interconnected by curved coupling links 43, 44 into a rollable assembly for rolling on drum 3. Each coupling link 43, 44 is formed with an opening 43*a*, 44*a*, at its opposite ends, with the openings of adjacent links 43 in alignment and pivotally coupled to each other by coupling members 45, 46, one at each end of each slat 40. Coupling member 45 is formed with a pin 45*a* at one end received within aligned openings 43*a* of coupling links 43; and similarly coupling member 46 is formed with a pin 46*a* received within aligned openings 44*a* at the opposite ends of the slats assembly. The two pins 45*a*, 46*a*, thus serve as a horizontal axis about which the slat may be pivoted: to a horizontal position, which is the fully open position of the slat: to a vertical position, which is the fully closed position of the slat; or to a partially closed, intermediate position.

Pins 45*a* in the coupling members 45 at one end of the slat assembly 4 include tongues 45*b* which pass through slots 43*b* in the coupling links 43 and are received in the respective end of the slat 40 to prevent rotation of the slat 40 with respect to the coupling member 45. The opposite end of coupling member 45 is formed with a further pin 45*c* which cooperates with the tilting mechanism 5 as will be described more particularly below, to tilt the slats 40 to their open, partially-closed or fully closed positions.

Coupling members 46 are similarly constructed with pins 46*a* provided with tongues 46*b* received within slots 44*b* of the coupling links 44, and are received within the opposite end of the respective slat 40 such that each pin 46*a* is non-pivotally to its respective slat. Coupling member 46, however, does not include a pin corresponding to pin 45*c* in coupling member 45, but merely an enlarged head 46*c* to facilitate insertion or removal of the coupling member.

As noted above, the pins 45*a*, 46*a*, serve as the pivot axis for each slat 40. As can be seen particularly in FIGS. 2, 4 and 5, this pivot axis is eccentric with respect to the longitudinal axis of the slat. In addition, as shown particularly in FIGS. 4 and 5, the pivotal side of each slat is partially covered by the adjacent non-pivotal side of the next adjacent slat in the roll-up condition of the slat assembly. These features produce a very compact nesting arrangement for the slats when wound on the drum 3, and thereby decrease the size of the box needed to accommodate the rolled-up slat assembly.

The tilting mechanism, generally designated 5, includes a common actuator which cooperates with pins 45*c* at one end of the slat assembly 4 for tilting the stats 40 to their various positions. In the shutter of FIGS. 1–6, this common actuator is in the form of a channel member 50 (best seen in FIG. 2) extending vertically at one side of the shutter frame 2 the length of the window opening 21, and terminating below the drum 3 at the upper end of the shutter. Channel member 50 is open at its upper end and also at the side facing pins 45*c* of coupling members 45 so as to receive those pins at the ends of the slats 40. As will be described more particularly below, channel member 50 is movable rearwardly of frame to pivot the slats 40 to their open positions or forwardly of the frame to pivot the slats to their partially-closed or closed positions.

The above movement of channel member 50 is effected by an actuator is mechanism that includes a fingerpiece 51 extending through a slot 52 at the lower end of side 22 of frame 2. Fingerpiece 51 is one arm of a bell crank lever 53 pivotally mounted at an intermediate portion by an opening 53*a* received within a boss 53*b* in side 22 of the frame 2. The opposite end of bell crank lever 53 includes an arm 54 formed with an opening 54*a* pivotally coupled by a pin 54*c* (FIG. 6) to channel member 50.

Channel member 50 is formed with two parallel sides 50*a*, 50*b* joined by a bridge 50*c* and open at the opposite side to receive the pins 45*c* of the coupling members 45. The bridging side 50*c* is coupled to arm 54 of the crank lever 53 by pins 54*c*, as shown particularly in FIG. 6.

It will thus be seen that pressing fingerpiece 51 downwardly rotates the crank lever 53 clockwise (FIG. 2) to raise arm 54 of the bell crank lever, and thereby to move coupling member 50 in the forward direction, i.e. towards the fingerpiece 51 projecting from the front side of the shutter frame 2; whereas moving fingerpiece 51 upwardly lowers arm 54 of belt crank lever 53 to move channel member 50 rearwardly within the frame.

A pair of parallelogram arms 55, 56 are pivotally mounted between channel member 50 and frame 2, on opposite sides of fingerpiece 51, to maintain channel member 50 vertical as it is moved to its forward and rearward positions by the fingerpiece. Thus, as shown particularly in FIG. 6*b,* the two arms 55, 56 are pivotally mounted at one of their ends to channel member 50, and at their opposite ends to frame 2. When fingerpiece 51 is in its down position, as shown in FIG. 6*b,* the channel member 50 is in its rearward position as shown in full lines in FIG. 6*b,* and the slats 40 are in their horizontal (open) positions as shown in FIG. 3; and when fingerpiece 51 is moved upwardly, as shown in broken lines in FIG. 6*b,* channel member 50 is moved forwardly (towards the fingerpiece side of the frame) by arm 54 of bell crank lever 53, while the two parallelogram arms 55, 56 are pivoted to vertical positions to maintain channel member 50 in a vertical position during its movement forwardly of the frame, as shown in broken lines in FIG. 6*b.* Pins 45*c* projecting from the ends of slats 40 and received within the channel member 50 causes the slats to pivot to vertical positions by this forward movement of the channel member.

The upper end of channel member 50 includes an inclined extension 50*d* (FIG. 2) which serves as a funnel-shaped element to guide the slat end pins 45*c* into the channel member, irrespective of the tilt position of the channel member, when the slat assembly is being rolled-down.

The actuator mechanism for the tilting assembly 5 further includes a force-releasable retainer device for retaining the fingerpiece 51, the channel member 50, and the slats 40 coupled thereto, in any selected position. As shown particularly in FIG. 6*b,* this retainer device comprises a toothed curved surface 57 fixed to the bell crank lever 53 at its pivotal mounting 53*a*, and a releasable leaf spring 58 engageable with the toothed surface. Leaf spring 58 is held at its opposite ends by a pair of L-shaped shoulders 59*a,* 59*b* fixed to the frame 2, and has an intermediate portion formed with a detent 58*a* for releasably receiving the teeth of the toothed surface 57. Thus, toothed surface 57 is rotated with the pivoting of fingerpiece 51 of bell crank lever 53 and is retained in a pivoted position by one of the teeth in surface 57 received within detent 58*a* of leaf spring 58.

Operation

The operation of the roll-up shutter illustrated in FIGS. 1–6 will be apparent from the above description.

Thus, when the slat assembly 4 is in its operative rolled-down position with respect to drum 3, the slats 40 in the slat assembly may be pivoted to any desired position by fingerpiece 51 of the tilting assembly 5 at the side of frame 2. When fingerpiece 51 is in its downward position, channel member 50 is pivoted by arm 54, at the other end of bell crank lever 53 from fingerpiece 51, to its rearward position within frame 2 as shown in FIG. 3, causing the slats 40 to be pivoted to their horizontal (fully open) positions by pins 45*c* projecting from the ends of the slats 40 received within channel member 50. Fingerpiece 51 may be raised to its uppermost position, shown in broken lines in FIG. 6*b,* whereupon channel member 50 is moved forwardly on the frame to the broken-line position illustrated in FIG. 6*b,* and thereby pivots the slats 40 to their vertical positions by the pins 45*c* at the ends of the slats being received within the channel member. Channel member 50 is maintained vertical during all of its movements by the parallelogram arrangement defined by the two parallel arms 55, 56 forming two sides of the parallelogram, and pivotal at their opposite ends to the channel member 50 and frame 2, forming the third and fourth sides of the parallelogram.

Fingerpiece 51 may thus be pivoted to its downmost position to move the slats 40 to their fully-pen (horizontally) positions, or to their fully-closed (vertical) positions. Fingerpiece 51, however, may also be moved to any intermediate position to partially close the slats as may be desired. The fingerpiece 51, channel member 50, and the slats 40 are all releaseably retained in any desired position by detent 58*a* of leaf spring 68 receiving one of the teeth of the toothed curved surface 57 fixed to fingerpiece 51.

The slat assembly 4 may be rolled-up to a non-operative position on drum 3 by rotating the drum via an electrical motor (not shown), or manually, as in a conventional roll-up shutter. However, in contrast to the conventional roll-up shutter, it is not necessary, in the construction illustrated in the drawings, first to tilt the slats 40 of the slat assembly 4 to their vertical (fully-closed) positions. Thus, as soon as pin 45*c* of a slat 40 clears channel member 50, as the slat assembly is wound onto drum 3, the respective slat 40 is no longer retained in its pivoted position, and therefore may pivot to a vertical position by its own weight as it is wound on the drum. When the slat assembly is rolled-down to an operative position, pins 45*c* are guided by tongues 50*d* of channel member 50 into the channel member, and thereby pivot the slats to the tilt positions as determined by the position of channel member 50 as set by fingerpiece 51.

It will thus be seen that, as shown in FIGS. 4 and 5, the slat assembly may be partially wound on the drum, and the unwound part may be tilted as deserved, to control the light.

The Shutter of FIGS. 7–15

The shutter illustrated in FIGS. 7–15 may also be partially wound on the drum, and the unwound part may be tilted as desired to control the light. It has the additional advantage, however, of permitting the tilting mechanism to be locked with the slats in their open, partially-closed or fully-closed positions. The shutter illustrated in FIG. 7 also includes a frame 102 having a drum or shaft 103 mounted horizontally at its upper end, and a slat assembly, generally designated 104, rollable on drum 103 to a fully or partially operative position, fully or partially covering the window (or door) opening framed by the shutter, or to a non-operative position wound on the drum 103. The illustrated shutter further includes a tilting assembly, generally designated 105, for tilting the slats of the slat assembly 4 to their open, partially-closed, or fully-closed positions, when the slat assembly is in its fully or partially operative position with respect to the window opening. As will be described more particularly below, tilting assembly 105 may also be selectively locked to lock the slats in their tilted positions.

The shutter illustrated in FIG. 7 also includes a common actuator extending the length of the window and terminating below the drum 103. In this case, the common actuator is in the form a rack bar 110 (FIGS. 8–11) formed with a first plurality of teeth 112 extending for the complete length of the bar, and a second plurality of teeth 114 (FIG. 10) extending only for a short part of the length of the bar. Teeth 114 are used for raising and lowering the rack bar 110 whereas teeth 112 are coupled to all the slats aligned with the window opening so as to tilt the slats towards their open positions when the rack bar 110 is raised, and towards their fully-closed positions when the rack bar is lowered.

Rack bar 110 is raised and lowered by rotating a rotary knob 120 carried at the end of a shaft 121 supported between a pair of bearing blocks 122, 123 (e.g., FIG. 9) for both rotary movement about rotary axis 124, and also linear movement along the rotary axis. Shaft 121 carries a gear 125 meshing with another gear 126 coupled to teeth 114 of rack bar 110, such that rotating knob 120 in one direction, raises the rack bar to pivot the slats towards their open positions, and rotating the knob in the opposite direction lowers the rack bar to pivot the slats towards closed positions.

Rotary knob 120 may also be used for locking the slats in a tilted position. For this purpose, bearing blocks 122, 123, rotatably mounting shaft 121 of knob 120, are pivotally coupled to one end 131 of a yoke member 130. The opposite end 132 of the yoke member is pivotally coupled to a tab 133 fixed to a locking bar 134 extending for the length of the rack bar 110. As will be described more particularly below, moving the rotary knob 120 inwardly to the position shown in FIG. 8, moves the locking bar 134 to a releasing position permitting the slats to be titled by rotating the knob; whereas moving the knob outwardly, to the position shown in FIGS. 9 and 11, moves the locking bar 134 to a locking position locking the slats in their tilted positions.

FIGS. 12–14 more particularly illustrate the tilting mounting of each of the slats 140 within the slat assembly 104. Thus, the opposite ends of each slat 140 are supported in the slat assembly by links 141, 142 which rotatably receive pins 143, 144 (FIGS. 13, 14) carried at the opposite ends of each slat. The end of each slat 140 is closed by an end piece 145, 146, formed with holes 145*a*, 146*a*, for receiving threaded fasteners to fix the end pieces to the ends of the slats.

Each end of each slat further includes a disc 147, 148 having an outer curved surface engaged by the outer concave surface of a filler block 149, 150 carried by the links 141, 142. The end discs 147, 148 support the slats 140 in a rolledcondition on drum 103, (e.g., FIG. 4) and are provided with axially extending-grooves 147*a,* 148*a,* to accommodate a screwdriver or like implement for threading the fasteners into the end pieces 145, 146, at,the ends of the slats 140.

Each slat 140 is further provided with a coupling mechanism coupling the slat to rack bar 110 for tilting the slats to a selected position when raising or lowering the rack bar by the rotary knob 120. This coupling mechanism includes an actuator disc 160 secured to the slat pin 143 such that rotation of the actuator disc also rotates the slat. The coupling mechanism co-operates with rack bar 110 such that, when the slat assembly is rolled onto the upper drum 103, all the slats 140 are automatically pivoted to their fully-closed positions to permit the slat assembly to be rolled onto the drum; and when the slat assembly is rolled down from the drum, all the slats are automatically pivoted to their fully open positions.

For this purpose, each actuator disc 160 fixed to a slat 140 is formed with a sector gear 161 which cooperates with teeth 112 of the rack bar 110. Each actuator disc 160 is further formed with a sector shaped cavity 162 in which a pair of pawls 163, 164 are pivotally mounted. As shown particularly in FIGS. 15 and 16, the two pawls 163, 164, are urged by a piano spring 165 against walls the 162*a,* 162*b* of the cavity 162.

In addition, the outer surface of each actuator disc 160 is flattened, as shown at the 166. One of these flattened surfaces is engaged by the previously-mentioned locking bar 134 when moved to its locking position, (as shown in FIG. 11 for example), by moving the rotary knob 120 outwardly. A locking disc 167 retains pawls 163, 164 within cavity 162 of the actuator disc 160. The other end of the slat includes a pair of locking discs 168, 169 for that end of the slat to its link 142.

Operation

The operation of the shutter illustrated in FIGS. 7–16 will now be described particularly with reference to FIGS. 15 and 16.

FIG. 15 illustrates the position of each slat 140 of the portion of the shutter aligned with the window (or door) opening shutter when the slat is in its fully-closed position; and FIG. 16 illustrates the condition of each slat when in its fully opened position. If the slats 140 are fully closed, rack bar 110 may be raised by rotating knob 120 which pivots the slats (clockwise, FIG. 15) to a fully opened position, or to any position in between; and if the slats are in their fully opened position (FIG. 16), the rack bar 110 may be lowered by rotating knob 120 in the opposite direction, which pivots the slats to their fully-closed positions or to any position in between. It will thus be seen by rotating knob 120, all the slats within the window opening may be tilted to any selected position by either raising or lowering rack bar 110.

If the slats are in the fully closed position shown in FIG. 15, and it is desired to roll-up the slat assembly onto the drum 103, the drum is rotated (manually or by a motor to raise the flat assembly with respect to the window opening. Rack bar 110 engages pawls 163 of all the slats within the window opening and pivots them clockwise, which is permitted by spring 165*s.* Also, the teeth of sector gear 162 of the actuator discs 160 fixed to the respective slats are disengaged from teeth 112 of rack bar 110. Accordingly, the rack bar 110 does not change the closed conditions of the slats as the slat assembly is rolled-up onto the drum 103. On the other hand, when the slats are initially in their closed conditions as illustrated in FIG. 15 and it is desired to lower the slat assembly, it will be seen that pawls 163 are moved by teeth 112 of rack bar 110 counter-clockwise, which thereby also rotates the actuator discs 160 and their respective slats 140 to counter-clockwise. This brings the teeth of sector gear 161 of disc 160 into engagement with teeth 112 of rack bar 110, such that lowering the slat assembly will pivot the slats 140 from their closed positions to their open positions as they enter the window opening and engage rack bar 110. Accordingly, the lowering of the shutter by rolling-down the slat assembly from drum 103 automatically pivots the slats from their closed positions to their fully-opened positions.

FIG. 16 illustrates what occurs when the slats 140 are in a fully opened position. Thus, if the shutter assembly is lowered, pawls 164 of the actuator discs 160 of the slats 140 in the window opening are pivoted counter-clockwise within cavity 162 of the respective actuator disc, and therefore do not rotate the respective actuator disc 160 or slat 140. In addition, the teeth of the sector gear 162 are also free of the teeth 112 of rack bar 110. Accordingly, lowering the shutter does not affect the open condition of the slats, and the slats in the window opening will therefore remain open.

On the other hand when the shutter is raised and the slats are open as shown in FIG. 16, pawl 164 of each slot in the window opening is moved into engagement with shoulder 162*b* of cavity 162 of the respective actuator disc 160, thereby rotating the disc, and the shutter 140 therewith, clockwise. This brings the teeth of sector gear 161 into engagement with the teeth 112 of rack bar 110, to pivot the actuator disc 160, and the slat 140 coupled thereto, clockwise to the fully-closed position of the slat. Accordingly, when the shutter is rolled-up onto the drum 103, all the slats which were in an open position, or partially open position, are automatically pivoted to their closed positions by rack bar 110 to enable the slat assembly to be wound onto the drum 103.

Whenever the slat assembly is not fully wound onto the drum 103, so that at least a portion of the slat assembly is aligned with the window opening, the slats may not only be tilted to a desired tilted position (open, closed or partially-closed) by rotating knob 120, but may also be locked in the tilted position by pulling the knob 120 outwardly along its rotary axis 124. This is the condition illustrated in FIG. 11, wherein it will be seen that this outward movement of the rotary knob 120 pivots the locking bar 134 into engagement with the outer flat surfaces of all the actuator discs 160 of the slats 140 within the window opening, and thereby locking the slats against any tilting movement.

If the drum 103 is rotated by an electrical motor (rather than manually) an electrical interlock should be provided to prevent driving the drum 103 in either direction when the rotary knob 120 is moved to its outward, locking position. Thus, the circuit to the electrical motor driving the drum 103 should include an interlock switch actuated by any of the tilt-locking mechanism described above to open the circuit to the electrical motor when the rotary knob 120 is in its outer, locking position.

While the invention has been described with respect to two preferred embodiments, it will be appreciated that these are set forth merely for purposes of example, and that many further variations may be made. For example, the shutter can be designed such that the downward position of the fingerpiece in the shutter of FIGS. 1–6 will produce the downward positioning of the slats. Also, other arrangements could be provided to tilt and lock the slats, e.g., by an electrical motor, or this feature may be omitted. Further, the slats could be rolled down in their closed condition, rather than automatically opening them as they are rolled down. Many other variations, modifications and applications of the invention will be apparent.

What is claimed is:

1. A roll-up shutter, comprising:

a frame defining a window;

a rotary drum mounted horizontally at the upper end of the frame above said window;

a slat assembly including a plurality of interconnected pivotal slats;

said slat assembly being rollable on the drum to a rolled-up condition above said window, to a fully rolled-down condition fully covering said window, or to a partially rolled-down condition partially covering said window;

and a tilting assembly for selectively tilting said slats to an open position, a partially-closed position and a fully-closed position when the slat assembly at least partially covers said window, wherein said tilting assembly includes a common actuator extending the length of said window and terminating below said drum, said common actuator being coupled only to the slats aligned with the window in the fully rolled-down condition or partially rolled-down condition of the slat assembly for selectively tilting said coupled slats to an open, partially-closed, or fully-closed position.

2. The shutter according to claim 1, wherein:

said common actuator includes a channel member extending vertically at one side of said frame, said channel member being open at its upper end and along one side for receiving a pin at the end of each of said slats;

and said tilting assembly further includes an actuator mechanism for moving said channel member and the slat pins received therein to pivot the slats to their open, partially-closed, and fully-closed positions;

the upper end of the channel member being located below said rotatable drum such that when rolling-up the slat assembly onto the drum, the slat end pins leave said channel member thereby permitting the slats to pivot to their fully-closed positions.

3. The shutter according to claim 2, wherein said actuator mechanism comprises:

a fingerpiece pivotally mounted to the frame and pivotally coupled to said channel member;

and a pair of parallelogram arms located on opposite sides of said pivotal coupling of the fingerpiece to said frame and maintaining said channel member in a vertical position as it is moved to said open, partially-closed and fully-closed positions.

4. The shutter according to claim 3, wherein said pair of parallelogram arms are pivotally mounted at one end to said channel member and are pivotally mounted at their opposite ends to said frame.

5. The shutter according to claim 3, wherein said slat assembly comprises:

a coupling link for each slat at said one side of the frame;

each coupling link having a first pin at one end fixed to its respective slat, and a second pin at its opposite end constituting said slat pin received within said channel member.

6. The shutter according to claim 3, wherein said actuator mechanism comprises:

a bell crank lever pivotally mounted to said frame;

a first arm on one side of said pivotal mounting carrying said fingerpiece;

and a second arm on the other side of said pivotal mounting pivotally coupled to the channel member.

7. The shutter according to claim 6, wherein said actuator mechanism further includes a force-releasable retainer device for retaining the finger piece, the channel member, and the slat coupled thereto, in any selected position.

8. The shutter according to claim 7, wherein said releasable retainer device comprises a toothed curved surface fixed to said bell crank lever at the pivotal mounting thereof so as to be rotated with the pivotal mounting of the bell crank lever, and a releasable spring engageable with said toothed surface.

9. The shutter according to claim 8, wherein said releasable spring is a leaf spring held at its opposite ends by a pair of L-shaped shoulders integrally formed with the frame and having an intermediate section formed with a detent for releaseably receiving the teeth of the toothed surface.

10. The shutter according to claim 2, wherein said channel member includes a funnel-shaped element at its upper end to guide said slat end pins into the channel member irrespective of the tilt position of the channel member.

11. The shutter according to claim 1, wherein said slat assembly includes a plurality of curved coupling links at opposite ends of the slats coupling them together into a rollable assembly.

12. The shutter according to claim 1, wherein said plurality of slats are each pivotally mounted eccentrically with respect to the longitudinal axis of the slat.

13. The shutter according to claim 12, wherein the pivotal end of each slat is partially covered by the non-pivotal end of the next adjacent slat in the rolled-up condition of the slat assembly.

14. The shutter according to claim 1, wherein said slat assembly further includes a locking mechanism selectively movable to a locking position for locking the tilting mechanism against tilting said slats, or to a releasing position for releasing the tilting mechanism for tilting said slats.

15. The shutter according to claim 1, wherein;

said common actuator includes a vertical bar extending vertically at one side of said frame and coupled to the slats aligned with said window;

and said tilting assembly further includes a coupling mechanism for each slat coupling the slat to the vertical bar, and an actuator mechanism for moving said bar vertically in one direction to pivot the coupled slats towards their open positions, and in the opposite direction to pivot the coupled slats towards their fully-closed positions.

16. The shutter according to claim 15, wherein said coupling mechanism for each slat couples the respective slat to the vertical bar such that raising the slat assembly automatically closes all the slats, and lowering the slat assembly automatically opens the slats aligned with the window.

17. The shutter according to claim 15, wherein said coupling mechanism for each slat includes teeth formed on said vertical bar engagable with teeth carried by each of said slats.

18. The shutter according to claim 17, wherein said teeth carried by each of said slats are in a sector gear formed in an actuator disc fixed to each slat.

19. The shutter according to claim 18, wherein each actuator disc is further formed with a cavity of sector configuration, each actuator disc further including a pair of pawls pivotally mounted in said cavity and a spring urged to engage the sides of said cavity and to straddle said sector gear of the respective actuator disc, such that:

if the slat is initially closed, lowering the slat assembly opens the respective slat, and raising the slat assembly retains the slat closed;

and if the slat is initially open or partially open, lowering the slat assembly fully opens the slat, and raising the slat assembly closes the slat.

20. The shutter according to claim 15, wherein said actuator mechanism includes a rotary knob and gearing coupling said knob to said vertical bar such that rotating the knob in one direction about its rotary axis raises the vertical bar, and rotating the knob in the opposite direction about its rotary axis lowers the vertical bar.

21. The shutter according to claim 20, wherein said rotary knob is also movable linearly along its rotary axis and is coupled to a locking mechanism acting on said tilting mechanism, such that moving the knob linearly in one direction causes said locking mechanism to release the tilting mechanism for tilting the slats, and moving the knob linearly in the opposite direction releases said locking mechanism to permit said tilting mechanism to tilt the slats.

22. A roll-up shutter, comprising:

a frame defining a window;

a rotary drum mounted horizontally at the upper end of the frame above said window;

and a slat assembly including a plurality of interconnected pivotal slats, said slat assembly being rollable on the drum from a rolled-up condition above said window to a rolled-down condition covering said window;

wherein each of said plurality of slats being pivotally mounted eccentrically with respect to the longitudinal axis of the slat, wherein said shutter further comprises a tilting assembly for selectively tilting said slats to an open, partially closed, or fully-closed position when the slat assembly covers at least a part of said window, and wherein said tilting assembly includes a common actuator extending the length of said window and terminating below said drum, said common actuator being coupled only to the slats aligned with the window in the fully rolled-down condition or partially rolled-down condition of the slat assembly for selectively tilting said coupled slats to an open, partially closed, or fully closed position.

23. The shutter according to claim 22, wherein said tilting assembly includes:

a channel member extending vertically at one side of said frame, said channel member being open at its upper end and along one side for receiving a pin at the end of each of said slats;

and an actuator mechanism for moving said channel member and the slat pins received therein to pivot the slats to their open, partially-closed, and fully-closed positions;

the upper end of the channel member being located below said rotatable drum such that when rolling-up the slat assembly onto the drum, the slat end pins leave said channel member thereby permitting the slats to pivot to their fully-closed positions.

* * * * *